US008920106B2

(12) United States Patent
Seljestad

(10) Patent No.: US 8,920,106 B2
(45) Date of Patent: Dec. 30, 2014

(54) EXCAVATOR THUMB ASSEMBLY

(75) Inventor: Gregory A. Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 809 days.

(21) Appl. No.: 13/168,053

(22) Filed: Jun. 24, 2011

(65) Prior Publication Data

US 2012/0328400 A1 Dec. 27, 2012

(51) Int. Cl.
*E02F 3/96* (2006.01)
*E02F 3/40* (2006.01)

(52) U.S. Cl.
CPC ..... *E02F 3/404* (2013.01); *Y10S 37/903* (2013.01)
USPC ..... 414/723; 414/722; 414/724; 37/406; 37/903

(58) Field of Classification Search
CPC ..... E02F 3/404
USPC ..... 414/722, 723, 724; 37/406, 903
See application file for complete search history.

(56) References Cited

U.S. PATENT DOCUMENTS

| | | | | |
|---|---|---|---|---|
| 4,033,469 | A | 7/1977 | Frank | |
| 4,127,203 | A | 11/1978 | Arnold | |
| 4,531,883 | A | 7/1985 | Arnold | |
| 4,770,597 | A * | 9/1988 | Powers | 414/740 |
| 4,836,741 | A | 6/1989 | St. Louis et al. | |
| 4,890,974 | A | 1/1990 | Kistner | |
| 5,107,610 | A * | 4/1992 | Fusco | 37/444 |
| 5,437,145 | A | 8/1995 | Farley et al. | |
| 5,484,250 | A | 1/1996 | Gilmore, Jr. et al. | |
| 5,553,408 | A | 9/1996 | Townsend | |
| 6,203,267 | B1 | 3/2001 | Heiple et al. | |
| 6,209,237 | B1 | 4/2001 | Heiple et al. | |
| 2002/0101107 | A1 * | 8/2002 | Cunningham et al. | 297/377 |
| 2003/0167662 | A1 * | 9/2003 | Desrochers | 37/406 |
| 2005/0193599 | A1 * | 9/2005 | McCoy | 37/406 |
| 2007/0289173 | A1 | 12/2007 | Riffle | |

FOREIGN PATENT DOCUMENTS

| | | |
|---|---|---|
| FR | 2849008 | 12/2002 |

* cited by examiner

*Primary Examiner* — Scott Lowe
(74) *Attorney, Agent, or Firm* — Miller, Matthias & Hull

(57) ABSTRACT

A thumb assembly mountable to a lifting arm of an excavator includes a base member mountable to the lifting arm, the base member having a link mounting aperture, a thumb member pivotally connected to the base member, a link member having a base mounting aperture in a first end for coupling to the base member and a thumb mounting aperture in a second end for coupling to the thumb member, a removable pin receivable through the link mounting aperture and the base mounting aperture to connect the link member to the base member, and a connection-assist system disposed on at least one of the link member and base member, the connection-assist system configured to provide a visual indication that the thumb member and the link member are in a position such that the removable pin can be received through both the link mounting aperture and the base mounting aperture.

19 Claims, 5 Drawing Sheets

EXCAVATOR THUMB ASSEMBLY

TECHNICAL FIELD

The present disclosure relates to a thumb assembly used with a bucket on a prime mover such as an excavator. More particularly, the present disclosure relates to a thumb assembly with a connection assist system.

BACKGROUND

A thumb is an implement which is typically pivotally mounted on the underside of a stick of an excavator. The thumb opposes and cooperates with the excavator bucket for grasping material held between the bucket and the thumb. Stiff link thumbs are fixed relative to the stick, as opposed to hydraulically actuated thumbs. In use, the bucket is curled and uncurled relative to the stick to grasp and hold material between the bucket and thumb. Stiff link thumbs may be connected to the stick with a strut whose position can be adjusted to permit adjustment of the angle of the thumb relative to the stick. The strut may consist of a rigid link detachably securable by one or more pins to one of a number attachment points provided on the stick.

Typically, with current excavator thumb assemblies, to lock the thumb into a working position, one or more pins must be frictionally received through one or more holes on the link and one or more corresponding holes on the bracket or attachment point on the stick. Proper alignment, however, can be difficult since a typical excavator thumb assembly can exceed 600 pounds while the link can exceed 100 pounds.

U.S. Pat. No. 6,203,267 discloses a thumb assembly with a rigid strut connected to a bracket by a pin. The strut includes a T-shaped end that is received in a complementary slot in the bracket. While the T-shaped end and the slot will support the weight of the strut and thumb when the pin removed which can aid in connecting the strut to the bracket, the thumb assembly disclosed in the '267 patent adds significant complexity and cost to the thumb design and does not provide a visual indication when the strut and bracket are sufficiently aligned.

The present disclosure is directed to overcoming one or more of the problems as set forth above.

SUMMARY OF THE DISCLOSURE

In one aspect, the present disclosure is directed to a thumb assembly mountable to a lifting arm of an excavator, the thumb assembly including a base member mountable to the lifting arm, the base member having a link mounting aperture, a thumb member pivotally connected to the base member, a link member having a base mounting aperture in a first end for coupling to the base member and a thumb mounting aperture in a second end for coupling to the thumb member, a removable pin receivable through the link mounting aperture and the base mounting aperture to connect the link member to the base member, and a connection-assist system disposed on at least one of the link member and base member, the connection-assist system configured to provide a visual indication that the thumb member and the link member are in a position such that the removable pin can be received through both the link mounting aperture and the base mounting aperture.

In another aspect, the present disclosure is directed to an excavator having a lifting pivotally coupled to a bucket and a thumb assembly pivotally coupled to the lifting arm. The thumb assembly including a base member mountable to the lifting arm, the base member having a link mounting aperture, a thumb member pivotally connected to the base member, a link member having a base mounting aperture in a first end for coupling to the base member and a thumb mounting aperture in a second end for coupling to the thumb member, a removable pin receivable through the link mounting aperture and the base mounting aperture to connect the link member to the base member, and a connection-assist system disposed on at least one of the link member and base member, the connection-assist system configured to provide a visual indication that the thumb member and the link member are in a position such that the removable pin can be received through both the link mounting aperture and the base mounting aperture.

In another aspect, the present disclosure is directed to a method for changing working positions of an excavator stiff link thumb assembly having a link member coupled to a thumb member and a base member, the method including disconnecting the link from the base member, rotating the thumb to the desired working position, positioning a detent lock into a detent to provide a visual indication that the thumb member and the link member are in a position such that the link member may be reconnected to the base member; and reconnecting the link member to the base member.

Various embodiments of the present application contain only a subset of the advantages set forth. No one advantage is critical to the embodiments. Any claimed embodiment may be technically combined with any other claimed embodiment (s).

BRIEF DESCRIPTION OF THE DRAWINGS

The accompanying drawings illustrate presently preferred exemplary embodiments of the disclosure, and together with the general description given above and the detailed description of the preferred embodiments given below, serve to explain, by way of example, the principles of the disclosure.

DETAILED DESCRIPTION

Figure 1:
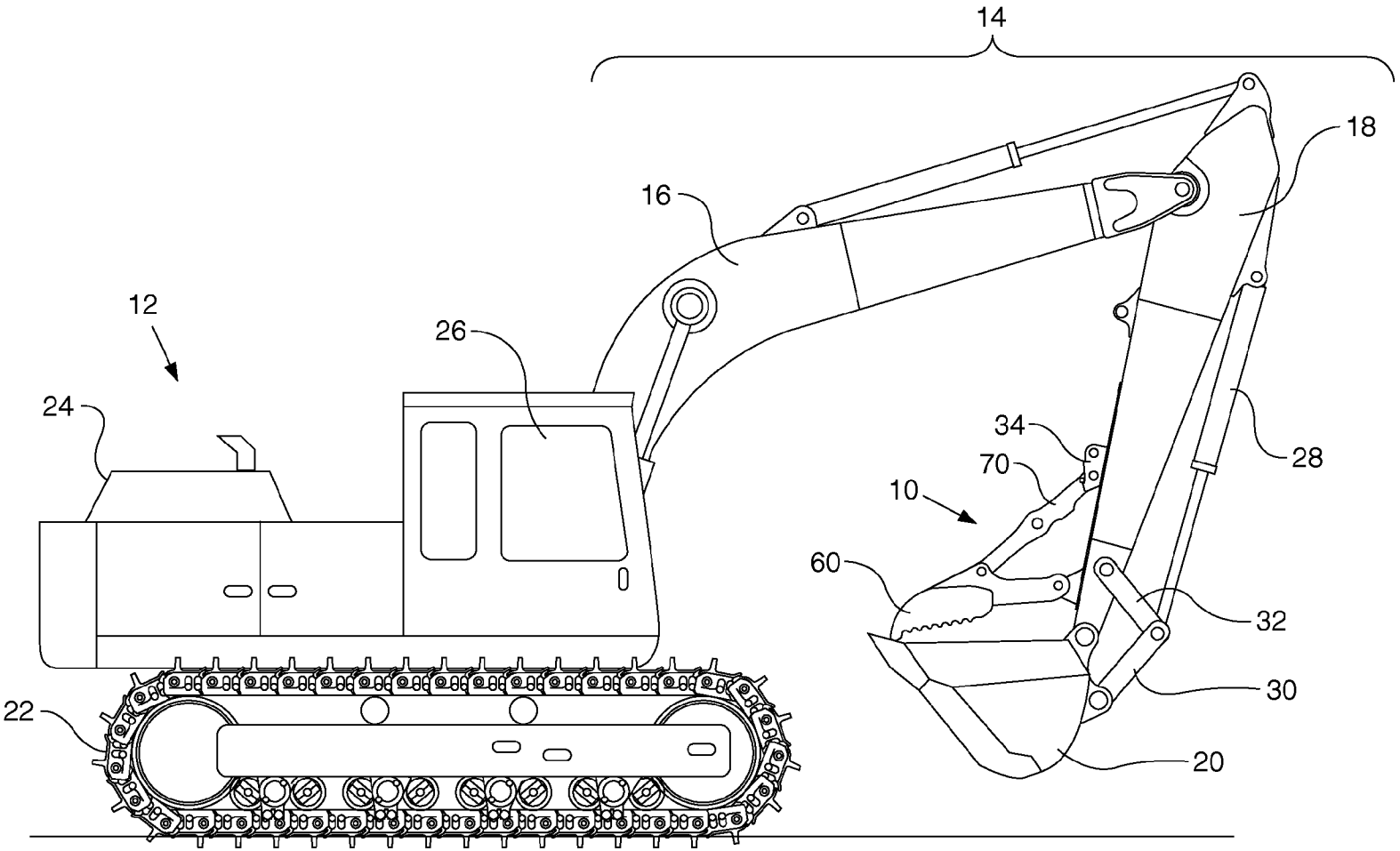
FIG. 1 is a side view of an excavator provided with a thumb assembly according to an exemplary embodiment of the present disclosure.

Referring to FIG. 1, a thumb assembly 10 including a base member 34, a thumb member 60, and a link member 70, is attached to a machine 12. Machine 12 may embody a fixed or mobile machine that performs some type of operation associated with an industry such as mining, construction, farming, transportation, or any other industry known in the art. For example, machine 12 may be an earth moving machine such as an excavator, a backhoe, or any other earth moving machine that could utilize a thumb assembly. Machine 12 may include an implement system 14 that includes a boom 16, a stick or lifting arm 18 pivotally attached to the boom, a bucket 20 pivotally attached to the stick, and the thumb assembly 10 pivotally attached to the stick. The machine 12 may also include a drive system 22 for propelling the machine 12, a power source 24 that provides power to the implement system 14 and the drive system 22, and an operator station 26 for operator control of implement system 14 and drive system 22.

The stick or lifting arm 18 is typically hydraulically operated to move the bucket 20 to a location where the bucket can be curled to scoop up material, and then to move the bucket 20 to a further location where the bucket can be uncurled to empty material from the bucket. The curling and uncurling of the bucket 20 may be controlled by a hydraulic ram 28 connected to the stick 18 and a series of linkage members 30, 32 which are pivotally connected to the stick 18 and bucket 20. The control of the bucket 20 does not form part of the present disclosure.

The power source 24 may embody an engine such as, for example, a diesel engine, a gasoline engine, a gaseous fuel-powered engine or any other type of combustion engine known in the art. It is contemplated that power source 24 may alternatively embody a non-combustion source of power such as a fuel cell, a power storage device, or another source known in the art. Power source 24 may produce a mechanical or electrical power output that may then be converted to hydraulic pneumatic power for moving the implement system 14.

Figure 2:
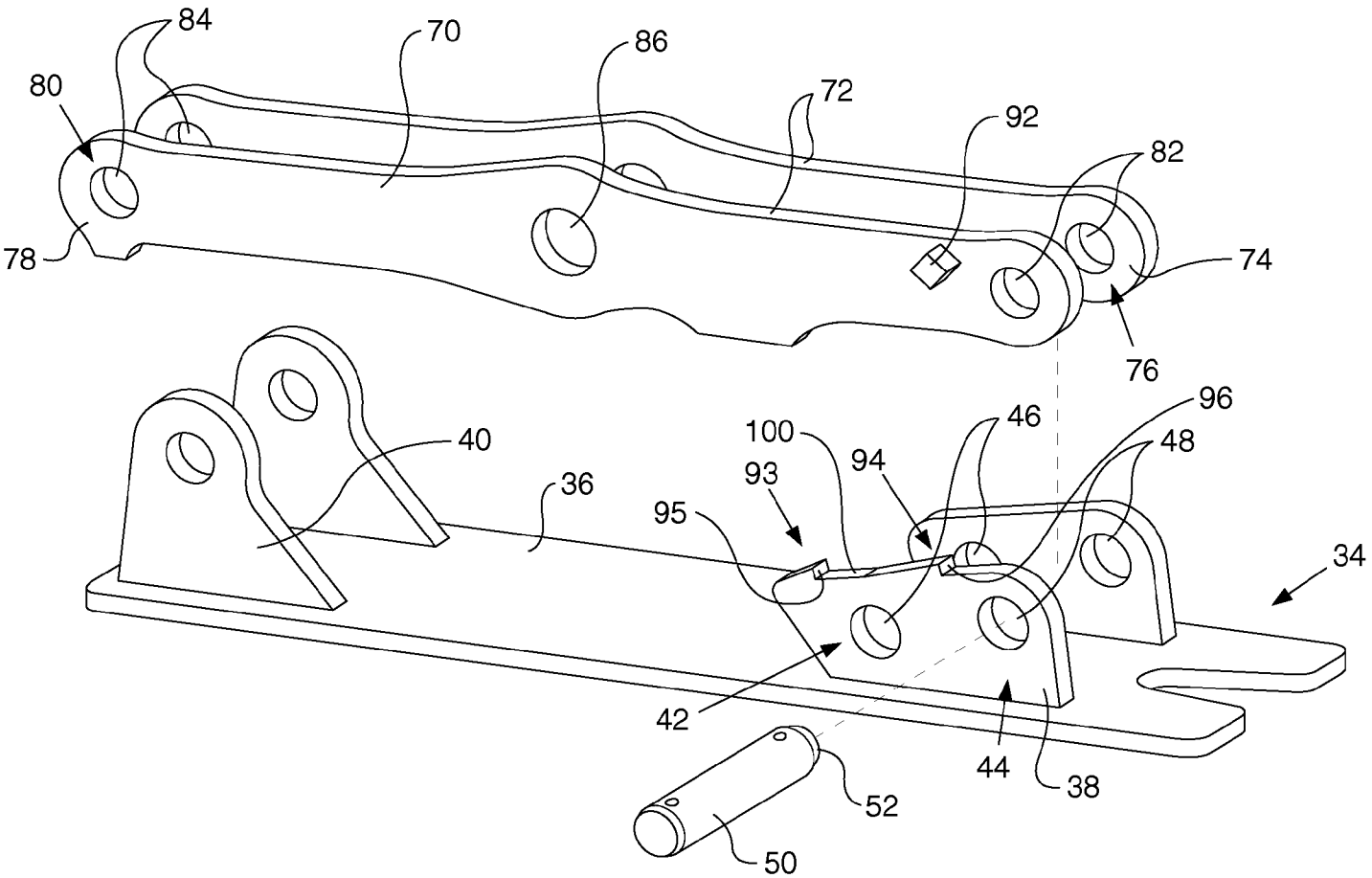
FIG. 2 is an exploded view of the thumb assembly of FIG. 1.
Figure 3:
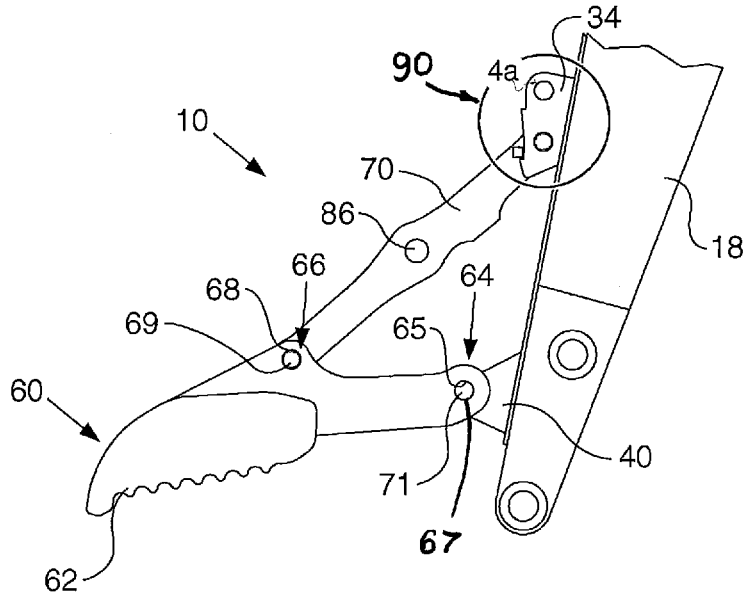
FIG. 3 is a diagrammatic illustration of the thumb assembly of FIG. 1 in a first working position.
Figure 3A:
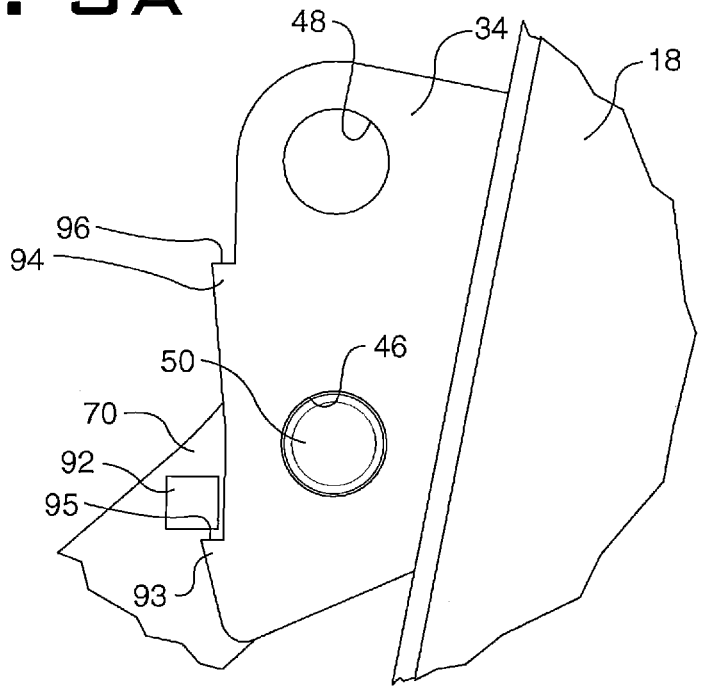
FIG. 3A is a partial enlarged view of a connection assist system of the thumb assembly of FIG. 1 in a first working position.
Figure 4:
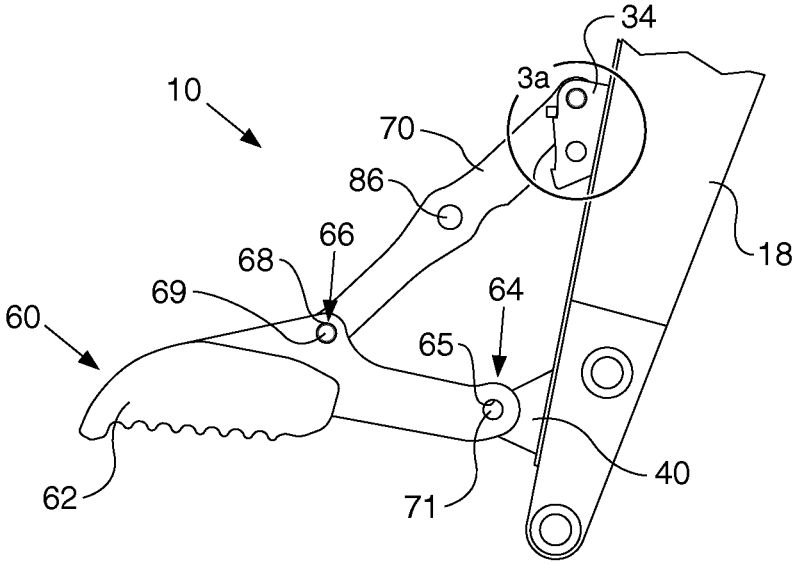
FIG. 4 is a diagrammatic illustration of the thumb assembly of FIG. 1 in a second working position.
Figure 4A:
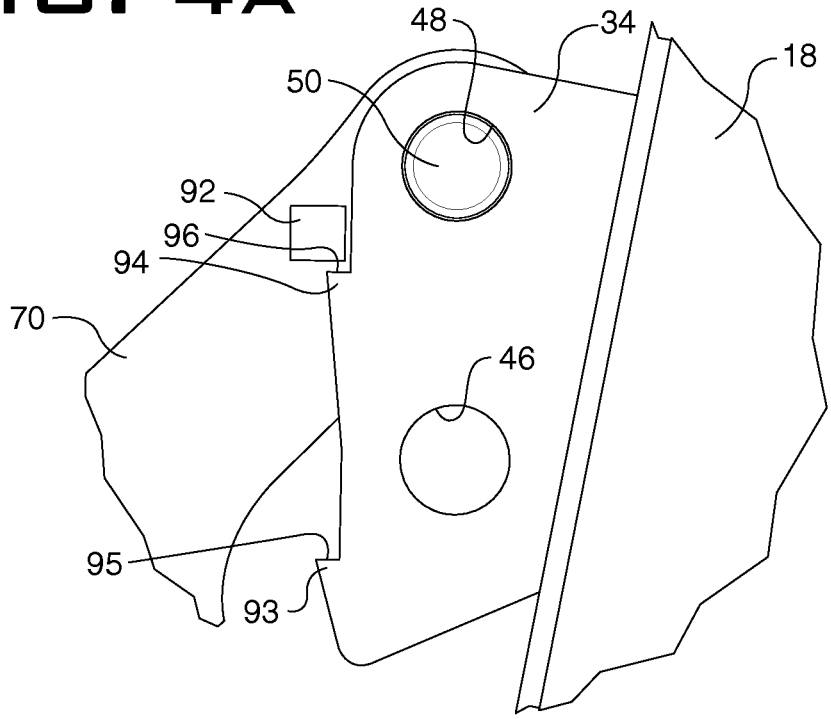
FIG. 4A is a partial enlarged view of a connection assist system of the thumb assembly of FIG. 1 in a second working position.

Referring to FIGS. 2-4, the base member 34 may be mounted to the stick 18 in any appropriate way, such as welding, fasteners, etc. In the illustrated example the base member 34 includes a base plate 36 which is attached to the underside of the stick or lifting arm 18 by welding. Mounted on the base plate 36 are two spaced apart link member mounting plates 38 and two spaced apart thumb mounting lugs 40. In other embodiments, more or less than two link member mounting plates 38 and two thumb mounting lugs 40 may be used. Each link member mounting plate 38 is provided with one or more attachment points or pivot joint locations 42, 44. In the illustrated example, each link member mounting plate 38 includes two pivot joint locations 42, 44 which are formed as a first pair of coaxial, circular link mounting apertures 46 and a second pair of coaxial, circular link mounting apertures 48 through which a removable pivot pin 50 can be fixed. Each pair of link mounting apertures 46, 48 correspond to a different working position of the thumb assembly 10.

The pivot joint locations 42, 44 may take different forms other than the simple apertures illustrated, as will be understood by those skilled in the art. For example, each pivot joint location 42, 44 may comprise means for receiving one or more fasteners which hold a mount (not shown) for a bearing or pin, so that a link member can be pivotally secured to the base member 34. Thus, in other embodiments, more or fewer pivot joint locations can be provided and the pivot joint locations may be formed in any suitable manner, such as any suitable number and shape of apertures and pin may be used.

The link member mounting plates 38 and thumb mounting lugs 40 of the base member 34 may be secured directly to the stick 18 without the base plate 36. Thus, the base member 34 may be two or more pieces. The thumb mounting lugs 40 may be replaced by any other suitable pivot mounting means. If required the thumb member 60 can be arranged to pivot on the pivot axis of the bucket 20.

The thumb member 60 may be configured in a variety of ways. Any structure capable of being rigidly fixed to the lifting arm of a prime mover and cooperate with a bucket to grasp material to be handled may be used. In the depicted embodiment, the thumb member 60 is a rigid structure that includes a first end 62 configured to engage the material to be handled and a second end 64 having a first pivot joint location 65 for connecting to the base member 34. The thumb member 60 also includes a second pivot joint location 66 for connecting to the link member 70. The first pivot joint location 65 is formed as a pair of coaxial, circular base mounting apertures 67 (only one shown) pivotally connected to the thumb mounting lugs 40 via a thumb mounting pin 71 and the second pivot joint location 66 is formed as a pair of coaxial, circular link mounting apertures 68 (only one shown) pivotally connected to the link member 70 via a link mounting pin 69 or any other suitable pivotal connection.

The link member 70 may be configured in a variety of ways. Any rigid link capable of being pivotally connected to both the thumb member 60 and the base member 34 may be used. In the illustrated embodiment, the link member 70 comprises two connected parallel plates 72. The link member 70 includes a first end 74 having a first pivot joint location 76 and a second end 78 having a second pivot joint location 80. In the illustrated example, the first pivot joint location 76 is formed as a first pair of coaxial, circular base mounting apertures 82 through which the removable pivot pin 50 can be fixed. Likewise, the second pivot joint location 80 is formed as a second pair of coaxial, circular thumb mounting apertures 84 through which link mounting pin 69 can be fixed.

The pivot joint locations 76, 80 may take different forms other than the simple apertures illustrated, as will be understood by those skilled in the art. For example, each pivot joint location 76, 80 may comprise means for receiving one or more fasteners which hold a mount (not shown) for a bearing or pin, so that the link member 70 can be pivotally secured to the base member 34 at the first end 74 and pivotally secured to the thumb member 60 at the second end 78. Thus, in other embodiments, more or fewer pivot joint locations can be provided and the pivot joint locations may be formed in any suitable manner, such as any suitable number and shape of apertures and pin may be used.

The link member 70 may also include one or more storage position apertures 86 for locking the link member 70 in a storage position via the removable pin 50 and the link mounting apertures 48. In the depicted embodiment, the one or more storage position apertures are formed as a pair of spaced apart, coaxial apertures 86 positioned between the base mounting apertures 82 at the first end 74 and the thumb mounting apertures 84 at the second end 78. For example, the storage position apertures 86 may be positioned along the length of the link member 70 approximately half way between the base mounting apertures 82 and the thumb mounting apertures 84. In the storage position, the link member 70 is folder back against the stick 18 such that the pin 50 (or other suitable pin) can be received through both the storage position apertures 86 and the second pair of link mounting apertures 48.

The thumb assembly 10 may also include a connection-assist system 90. The connection-assist system 90 may be configured in a variety of ways. Any system disposed on at least one of the link member and the base member and capable of providing a visual indication that the thumb member and the link member are in a position such that the link member can be coupled to an attachment point on the stick may be used. For example, in a position such that the removable pin 50 can be received through both one of the pair of the link mounting apertures 46, 48 on the base member 34 and the base mounting aperture(s) 82 on the link member 70.

In the depicted embodiment, the connection-assist system 90 is configured as a detent or catch system. In particular, the connection-assist system 90 includes a projection or detent lock 92 disposed on the link member 70, a first detent or catch 93 disposed on the base member 34, and a second detent or catch 94 disposed on the base member 34. The projection or detent lock 92 and the detents or catches 93, 94 may be configured in a variety of ways. Any structure that can cooperate to provide a visual indication may be used. In the depicted embodiment, on one of the pair of parallel plates 72 of the link member 70, adjacent one of the base mounting apertures 82, a projection 92 is disposed. The projection 92 is configured as a square, approximately one inch block extending generally perpendicular from one of the plates 72 and is configured to generally mate with one of the catches 93, 94. The projection or detent lock 92 can be attached to the link member 70 in any suitable manner, such as welding for example. On one of the pair of link member mounting plates 38, the first catch 93 and the second catch 94 are configured to present first and second shoulders 95, 96, respectively, which the projection 92 may engage. A person having ordinary skill in the art will appreciate that the shape, size, location, and number of projections and/or catches may vary for different embodiments.

In the illustrated embodiment, the removable pin 50 is a generally cylindrical rod configured to be tightly received through various apertures in the thumb assembly. For example, the removable pin 50 may be configured to be received through the base mounting apertures 82 and the storage position apertures 86 on the link member 70 and through the link mounting apertures 46, 48 on the base member 34. The removable pin 50 includes at least one tapered end 52 to assist in installation of the pin through multiple apertures that are slightly misaligned. The pin 50 may be tapered only on one end, on both ends, or may have a slight taper along the majority of the length of the pin.

In operation, the depicted thumb assembly 10 has two working positions, though in other embodiments, the thumb assembly may have more or less than two working positions. Referring to FIGS. 3, 3A, 4, and 4A, in both working positions, the base member 34 is connected to the stick 18, the thumb member 60 is pivotally connected to the base member 34, the second end 78 of the link member 70 is coupled to the thumb member 60, and the first end 74 of the link member 70 is connected to the base member 34 via the removable pin 50. The difference between the first working position (FIG. 3) and second working position (FIG. 4) is which pair of link mounting apertures 46, 48 the first end of the link member 70 attaches. In the position illustrated in FIG. 3, the link member 70 is attached to the first pair of link mounting apertures 46 and in the position illustrated in FIG. 4, the link member 70 is attached to the second pair link mounting apertures 48.

The thumb assembly 10 is configured to be easily moved between the first and second working positions. For example, to move from the first position to the second position, the stick 18 and bucket 20 are curled into the position generally illustrated in FIG. 1 (i.e. a position in which the bucket 20 is in contact with the thumb member 60). In this position, the bucket 20 supports the weight of the thumb member 60 and link member 70 so that the pin 50 can be removed to decouple the first end 74 of the link member 70 from the base member 34. With the pin 50 removed, the projection 92 engages the first catch 94 such that the connect-assist system 90 can support or partially support the weight of the thumb member 60 and link member 70.

The bucket 20 can then be further curled (clockwise in the view of FIG. 1) to pivot the thumb member 60 (clockwise). . Since the second end 78 of the link member 70 is still coupled to the thumb member 60, the link member 70 will follow the movement of the thumb member 60. Due to the angle of the stick 18, the projection 92 will leave the first detent or catch 93 and slide along a top edge 100 of the link member mounting plates 38, or be moved without contacting the top edge 100, until it reaches the second detent or catch 94. Once the projection 92 reaches the second detent or catch 94, the projection 92 will fall into or be caught by the second detent or catch 94. In this position, the thumb member 60 and the link member 70 are in a position such that the pin 50 can be received through both the second link mounting aperture(s) 48 and the base mounting aperture(s) 82. The projection 92 and the second catch 94 cooperate to provide a visual indication that the link member 70 and base member 34 are in positioned to be coupled (e.g. the second link mounting aperture(s) 48 and the base mounting aperture(s) 82 are sufficiently aligned to receive the pin). The projection 92 and the second catch 94 may also cooperate to support or partially support the weight of the thumb member 60 and link member 70 along with the bucket 20.

Figure 5:
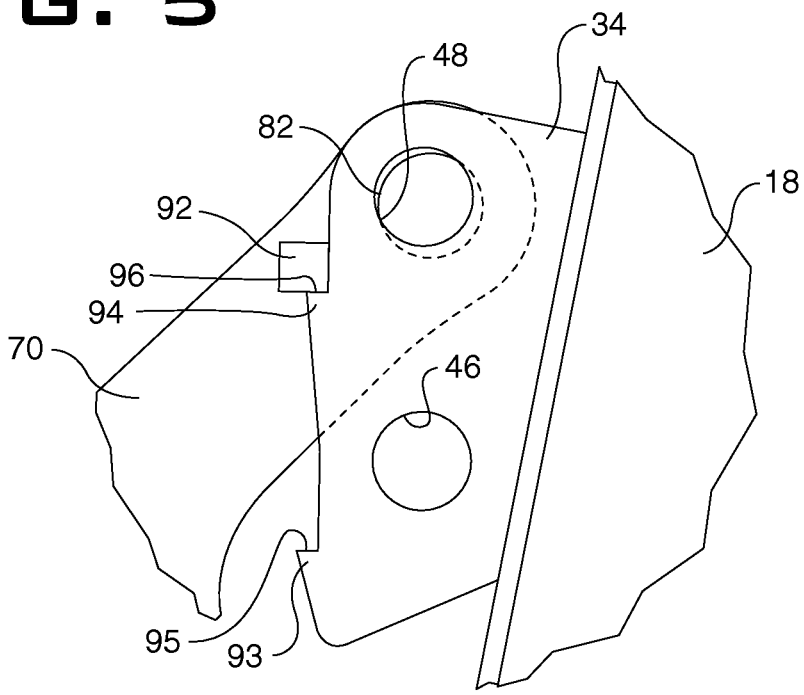
FIG. 5 is a partial enlarged view of the connection assist system of the thumb assembly of FIG. 1 without a pin inserted.
Figure 6:
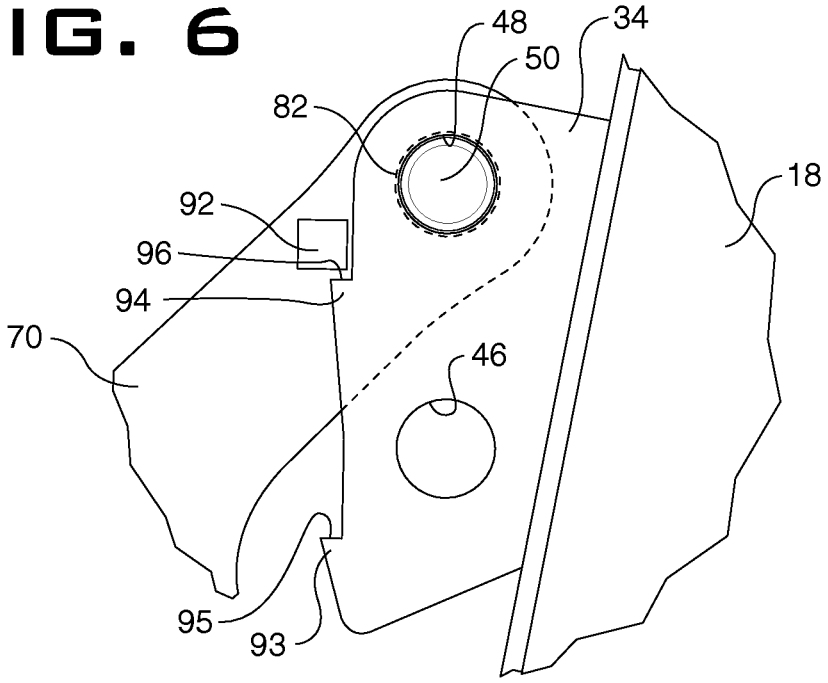
FIG. 6 shows a partial enlarged view of the connection assist system of the thumb assembly of FIG. 1 with a pin inserted.

Referring to FIGS. 5 and 6, in this position, the base mounting apertures 82 on the link member 70 and the second link mounting apertures 48 on the base member 34 overlap axially enough to allow the removable pin 50 to be inserted through both the base mounting apertures 82 and second link mounting apertures 48. In the depicted embodiment, however, without the pin 50 installed, the base mounting apertures 82 and link mounting apertures 46 are not coaxially aligned (as shown in FIG. 5). Instead, the base mounting apertures 82 and second link mounting apertures 48 are slightly misaligned. Installation of the pin 50 aligns the base mounting apertures 82 and the second link mounting apertures 48 coaxially, which results in the projection 92 disengaging from the second detent or catch 94 (as shown in FIG. 6). The tapered end 52 of the pin 50 helps facilitate insertion into the slightly misaligned apertures and subsequent aligning of the apertures. Thus, when the bucket 20 is uncurled, the pin 50 now supports the weight of the thumb member 60 and link member 70. In other embodiments, however, the base mounting apertures 82 and the link mounting apertures 46, 48 may be coaxially aligned when the detent lock or projection engages the detent or catch.

Movement from the second position to the first position can be accomplished in a similar manner.

Industrial Applicability

The disclosed thumb assemblies 10 are particularly suitable for excavators, such as shown at 12 in FIG. 1 for purposes of cooperating with a bucket 20 to grasp objects between the thumb member 60 and bucket 20. The disclosed thumb assemblies 10 may be easily placed in various working positions despite being heavy and cumbersome. The connection-assist system 90 provides a convenient visual indication that the thumb member and the link member are in a position such that the link member may be connected to the base member. Further, the connection-assist system can support or partially support the weight of the thumb member and link member while an operator makes the connection between the link member 70 and one of the attachment points 42, 44 on the stick 18. Thus, for example, an operator has a clear indication of when the apertures on the link member and base member are sufficiently aligned to receive a pin.

It will be apparent to those skilled in the art that various modifications and variations can be made to the thumb assembly and the method of moving a thumb member of a thumb assembly. Other embodiments will be apparent to those skilled in the art from consideration of the specification and practice of the disclosed thumb assembly and the method of moving a thumb member of a thumb assembly. It is intended that the specification and examples be considered as exemplary only, with a true scope being indicated by the following claims and their equivalents.

What is claimed is:

1. A thumb assembly for an excavator having a lifting arm, the thumb assembly comprising:

a base member coupled to the lifting arm, the base member including a link member mounting plate defining a first link mounting aperture and a second link mounting aperture, and a thumb mounting lug;

a thumb member defining a first pivot joint and a second pivot joint, the thumb member being pivotally connected to the thumb mounting lug at the second pivot joint;

a link member having a first end defining a base mounting aperture and a second end defining a thumb mounting aperture, the link member being pivotably coupled to the thumb member first pivot joint at the thumb mounting aperture, the link member having a first working position, in which the base mounting aperture is adjacent to the first link mounting aperture, and a second working position, in which the base mounting aperture is adjacent to the second link mounting aperture;

a removable pin sized for insertion through the first and second link mounting apertures and the base mounting aperture to connect the link member to the base member; and a connection-assist system including:

a first catch formed on the link member mounting plate positioned a first predetermined distance from the first link mounting aperture;

a second catch formed on the link member mounting plate positioned a second predetermined distance from the second link mounting aperture, the second predetermined distance being substantially equal to the first predetermined distance; and a projection coupled to the link member first end, shaped complementary to the first and second catches, and spaced a third predetermined distance from the base mounting aperture, the third predetermined distance being substantially equal to the first and second predetermined distances so that the projection provides a first visual indication that the link is substantially in the first working position when the projection mates with the first catch, and a second visual indication that the link is substantially in the second working position when the projection mates with the second catch.

2. The thumb assembly of claim 1 wherein the base member comprises two spaced apart, link member mounting plates, each mounting plate having a first link mounting aperture and a second link mounting aperture, and at least one of the link mounting plates includes the first and second catches.

3. The thumb assembly of claim 1 wherein in the first working position, the first link mounting aperture and the base mounting aperture are misaligned.

4. The thumb assembly of claim 3 wherein insertion of the removable pin through the first link mounting aperture and the base mounting aperture substantially aligns the apertures coaxially.

5. The thumb assembly of claim 1 wherein the link member further comprises a storage position aperture disposed between the base mounting aperture and the thumb mounting aperture.

6. The thumb assembly of claim 1 wherein the connection-assist system supports at least a portion of the weight of the thumb member and the link member when the link member is in one of the first and second positions such that the removable pin can be received through both the base mounting aperture and one of the first and second link mounting apertures.

7. The thumb assembly of claim 1, in which the projection extends perpendicular from the link member.

8. The thumb assembly of claim 1, in which the projection has a square cross sectional shape.

9. The thumb assembly of claim 1, in which the first catch defines a first shoulder configured to engage at least a portion of the projection, and in which the second catch defines a second shoulder configured to engage at least a portion of the projection.

10. The thumb assembly of claim 9, in which the first and second shoulders are disposed on an edge surface of the link member mounting plate.

11. A method for changing working positions of an excavator stiff link thumb assembly having a link member coupled to a thumb member and a base member, the method comprising:

providing the base member with a first link mounting aperture, a second link mounting aperture, a first catch spaced a first predetermined distance from the first link mounting aperture, and a second catch spaced a second predetermined distance from the second link mounting aperture, the second predetermined distance being substantially equal to the first predetermined distance;

providing the link member with a base mounting aperture, the link member having a first working position, in which the base mounting aperture is adjacent to the first link mounting aperture, and a second working position, in which the base mounting aperture is adjacent to the second link mounting aperture;

providing the link member with a projection shaped complementary to the first and second catches, and spaced a third predetermined distance from the base mounting aperture, the third predetermined distance being substantially equal to the first and second predetermined distances so that the projection provides a first visual indication that the link is substantially in the first working position when the projection mates with the first catch, and a second visual indication that the link is substantially in the second working position when the projection mates with the second catch;

disconnecting the link member from the base member;

rotating the link member and thumb member until the projection engages one of the first and second catches; and reconnecting the link member to the base member.

12. The method of claim 11 wherein the rotating the link member and thumb member further comprises positioning the base mounting aperture on the link member adjacent one of the first and second link mounting apertures on the base member such that the base mounting aperture and the one of the first and second link mounting apertures are axially misaligned but sufficient overlapping to receive a mounting pin therethrough.

13. The method of claim 12 wherein reconnecting the link member to the base member further comprises inserting the mounting pin through both the base mounting aperture and the one of the first and second link mounting apertures.

14. The method of claim 13 wherein the step of reconnecting the link member to the base member coaxially aligns the base mounting aperture with the one of the first and second link mounting apertures.

15. An excavator comprising:

a lifting arm pivotally coupled to a bucket;

a thumb assembly pivotally coupled to the lifting arm, the thumb assembly comprising:

a base member coupled to the lifting arm, the base member including a link member mounting plate defining a first link mounting aperture and a second link mounting aperture, and a thumb mounting lug;

a thumb member defining a first pivot joint and a second pivot joint, the thumb member being pivotally connected to the thumb mounting lug at the second pivot joint;

a link member having a first end defining a base mounting aperture and a second end defining a thumb mounting aperture, the link member being pivotably coupled to the thumb member first pivot joint at the thumb mounting aperture, the link member having a first working position, in which the base mounting aperture is adjacent to the first link mounting aperture, and a second working position, in which the base mounting aperture is adjacent to the second link mounting aperture;

a removable pin sized for insertion through the first and second link mounting apertures and the base mounting aperture to connect the link member to the base member; and a connection-assist system including:

a first catch formed on the link member mounting plate positioned a first predetermined distance from the first link mounting aperture;

a second catch formed on the link member mounting plate positioned a second predetermined distance from the second link mounting aperture, the second predetermined distance being substantially equal to the first predetermined distance; and a projection coupled to the link member first end, shaped complementary to the first and second catches, and spaced a third predetermined distance from the base mounting aperture, the third predetermined distance being substantially equal to the first and second predetermined distances so that the projection provides a first visual indication that the link is substantially in the first working position when the projection mates with the first catch, and a second visual indication that the link is substantially in the second working position when the projection mates with the second catch.

16. The excavator of claim 15, in which the projection extends perpendicular from the link member.

17. The excavator of claim 15, in which the projection has a square cross-sectional shape.

18. The excavator of claim 15, in which the first catch defines a first shoulder configured to engage at least a portion of the projection, and in which the second catch defines a second shoulder configured to engage at least a portion of the projection.

19. The excavator of claim 18, in which the first and second shoulders are disposed on an edge surface of the link member mounting plate.

* * * * *

UNITED STATES PATENT AND TRADEMARK OFFICE

CERTIFICATE OF CORRECTION

PATENT NO. : 8,920,106 B2
APPLICATION NO. : 13/168053
DATED : December 30, 2014
INVENTOR(S) : Gregory A. Seljestad It is certified that error appears in the above-identified patent and that said Letters Patent is hereby corrected as shown below:

Column 6, line 46, delete "Industrial Applicability" and insert -- INDUSTRIAL APPLICABILITY --.

Signed and Sealed this
Seventeenth Day of November, 2015

Michelle K. Lee

Michelle K. Lee
*Director of the United States Patent and Trademark Office*